US005681187A

United States Patent [19]

Fukushima et al.

[11] Patent Number: 5,681,187

[45] Date of Patent: Oct. 28, 1997

[54] CONNECTOR WITH MOVABLE CONTACT MEMBER AND RESILIENT CONTACT BAND

[75] Inventors: Hirotaka Fukushima; Toshiaki Hasegawa, both of Shizuoka, Japan

[73] Assignee: Yazaki Corporation, Tokyo, Japan

[21] Appl. No.: 693,604

[22] Filed: Aug. 7, 1996

[30] Foreign Application Priority Data

Aug. 29, 1995 [JP] Japan ..... 7-220582

[51] Int. Cl.[6] ..... H01R 13/28

[52] U.S. Cl. ..... 439/700; 439/824; 439/843; 439/138; 439/921

[58] Field of Search ..... 439/289, 700, 439/824, 181, 183, 185, 186, 187, 843, 927, 582

[56] References Cited

U.S. PATENT DOCUMENTS

| | | | |
|---|---|---|---|
| 1,392,558 | 10/1921 | Darrah et al. | 439/289 |
| 3,474,386 | 10/1969 | Link | 439/181 |
| 3,513,425 | 5/1970 | Arndt | 439/582 |
| 4,176,897 | 12/1979 | Cameron | 439/138 |
| 4,773,872 | 9/1988 | Borgstrom et al. | 439/187 |
| 4,786,262 | 11/1988 | Molitor et al. | 439/843 |

FOREIGN PATENT DOCUMENTS

| | | | |
|---|---|---|---|
| 63-99773 | 6/1988 | Japan | H01R 13/15 |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

A connector in which the sliding movement of a movable contact member is stabilized, thereby securing a positive electrical connection. In the connector of the invention, a hollow connection terminal is fitted in a connector housing, and a coil spring and the slidable, movable contact member are received in this connection terminal. When the two connectors are fitted together, the coil spring urges the movable contact member toward a front end of the connector, thereby providing a sufficient contact load. A resilient, electrically-conductive contact band is provided in a gap between an outer peripheral surface of the movable contact member and an inner peripheral surface of the connection terminal. The connection terminal and the movable contact member are electrically connected together through this contact band, and this contact band prevents the movable contact member from being displaced in a direction perpendicular to the direction of fitting of the connection (that is, the axial direction). Therefore, a more stable sliding movement of the movable contact member is achieved, and a positive electrical connection is achieved.

15 Claims, 4 Drawing Sheets

10
11
11a
12
12a
12b
13
14
15
16
17
18
19
19
21
22
23
24
25
Wo 30
31
32
33
34
35
36
37
38
W1

W0
24
10
11
12
12a
13
14
15
30
31
32
38
W1

CONNECTOR WITH MOVABLE CONTACT MEMBER AND RESILIENT CONTACT BAND

BACKGROUND OF THE INVENTION

1. Field of the Invention

This invention relates to a connector for large current used in an electric car or the like, and more particularly to a connector having a movable contact member of the butting type fitted in a connector housing.

2. Background

Usually, a connector for large current is mounted on an electric car or the like, and a contact of a contact member in such a connector is either of the insertion type or of the butting type. In the insertion type, alignment, as well as a large insertion force, is required, and therefore the butting-type contact member as disclosed in Examined Japanese Utility Model Publication No. Sho. 63-99773 has extensively been used.

As shown in FIG. 6, when a movable contact member 6 is brought into butting contact with a fixed contact member 8, an electrical connection between the two is achieved. As shown in FIG. 7, the movable contact member 6 has a socket portion 6*a* opening to a rear end thereof, and a pin portion 7*a* formed at a front end of a sliding contact member 7 is inserted into the socket portion 6*a*, and a coil spring 4 is wound around the pin portion 7*a* and the movable contact member 6. In this condition, the movable contact member 6 is inserted into a sleeve 5 of a connector housing.

With this construction in which the pin portion 7*a* of the sliding contact member 7 is inserted into the socket portion 6*a* of the movable contact member 6, the sliding movement replaces a flexing movement, and therefore the need for flexible conductive wires or the like is obviated, and the lifetime of the connector which is very frequently operated is prolonged. The socket portion 6*a* and the pin portion 7*a* serve as a kind of electrical contact, and therefore in its open condition, the contact of the movable contact member 6 is under no pressure or load. Therefore, trouble such as grounding can be prevented, and enhanced safety and maintainability can be achieved.

However, the condition of contact between the movable contact member 6 and the sliding contact member 7 is determined by the inner diameter of the socket portion 6*a* and the outer diameter of the pin portion 7*a*. More specifically, if the inner diameter of the socket portion 6*a* is too close to the outer diameter of the pin portion 7*a*, a good sliding movement is not achieved although the good contact condition is maintained. In contrast, if the inner diameter of the socket portion 6*a* is too different from the outer diameter of the pin portion 7*a*, the contact condition is unstable although good sliding movement is obtained. Therefore, in order to achieve the optimum contact condition and the optimum sliding movement, the inner diameter of the socket portion 6*a* and the outer diameter of the pin portion 7*a* are required to have high dimensional accuracy, which increases the cost of the connector.

Another problem is that when dirt or dust intrudes into the area of sliding contact between the socket portion 6*a* and the pin portion 7*a*, it causes a malfunction due to an incomplete contact condition.

SUMMARY OF THE INVENTION

It is an object of this invention to provide a connector in which the sliding movement of a movable contact member is stabilized, thereby securing a positive electrical connection.

The above object of the invention has been achieved by a connector for fitting connection to a mating connector having a fixed terminal fitted in a connector housing thereof, the connector having a movable contact member fitted in a connector housing thereof for sliding movement along an axis of the connector housing, wherein when the two connectors are fitted together, the movable contact member is brought into abutting contact with the fixed terminal, thereby electrically connecting the two connectors together. The movable contact member, together with a coil spring, is received in a connection terminal made of an electrically-conductive material; and a contact band, made of a resilient, electrically-conductive material, is slidably provided in a gap between the connection terminal and the movable contact member.

In the connector of the above construction, before the two connectors are fitted together, the connection terminal, electrically connected to the connection wire fixedly connected to the rear end of the connector housing, is electrically connected to the slidable, movable contact member through the contact band. When the connector is fitted on the mating connector, a front end portion of the movable contact member is brought into abutting contact with a front end portion of the fixed terminal in the mating connector, so that the electrical connection of the connector to the mating connector is achieved.

More specifically, in the process of mating the two connectors, the front end portion of the movable contact member is brought into abutting contact with the front end portion of the fixed terminal, and then as this fitting operation further proceeds, the movable contact member is pressed by the fixed terminal, and is slidingly moved rearward against a resilient force of the coil spring. Then, when the fitting between the two connectors is completed, the front end portion of the movable contact member is held in firm abutting contact with the front end portion of the fixed terminal by the resilient force of the coil spring, thereby achieving a positive electrical connection.

At this time, the contact band (which is made of the resilient, electrically-conductive material), slidably provided in the gap between the slidable, movable contact member and the connection terminal fixedly mounted within the connector housing, prevents the movable contact member from being displaced in a direction perpendicular to the direction of sliding of a movable contact member, and therefore the more stable sliding movement is achieved.

DETAILED DESCRIPTION OF THE PREFERRED EMBODIMENT

Figure 1:
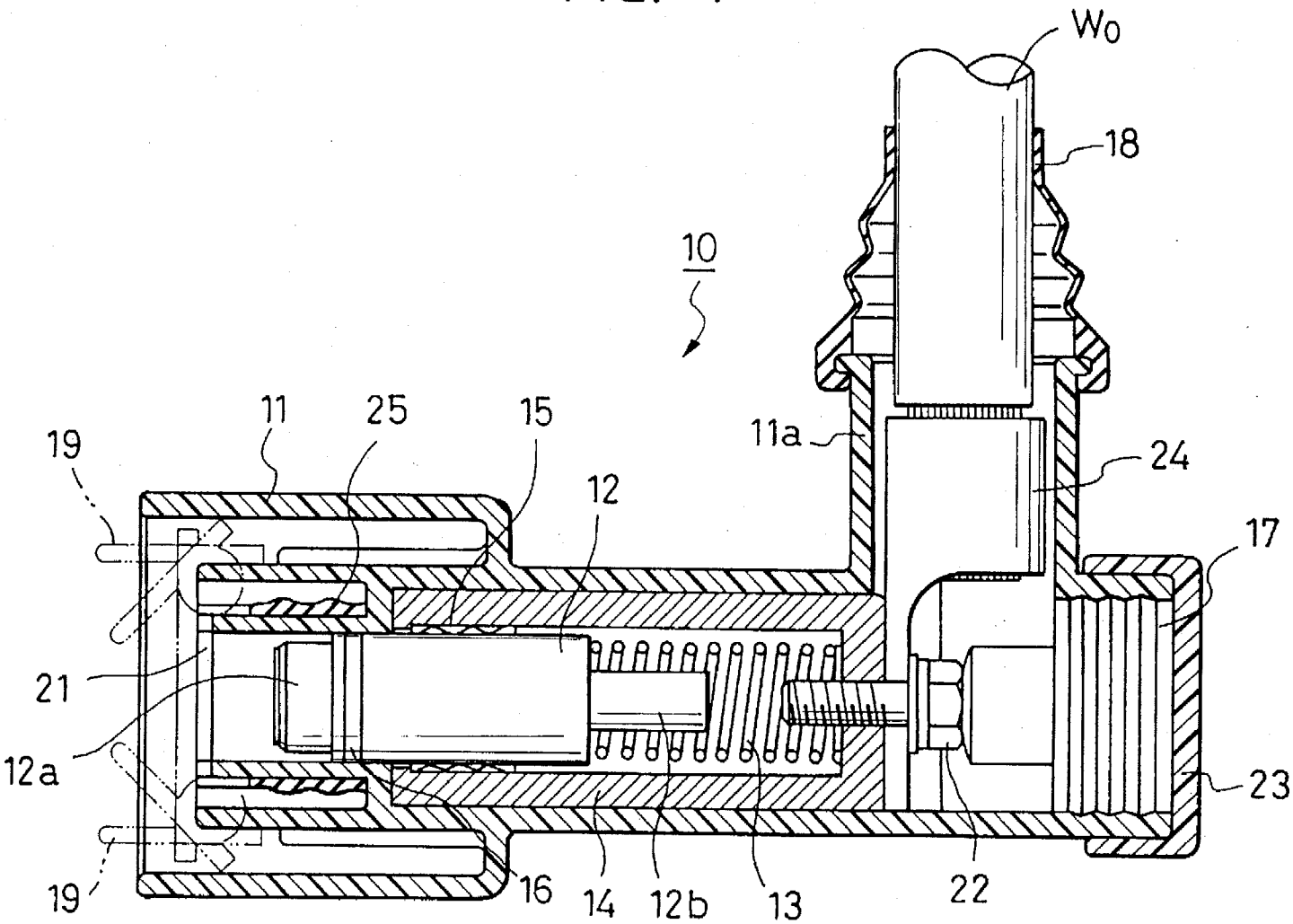
FIG. 1 is a cross-sectional view showing a preferred embodiment of a connector of the present invention.
Figure 3:
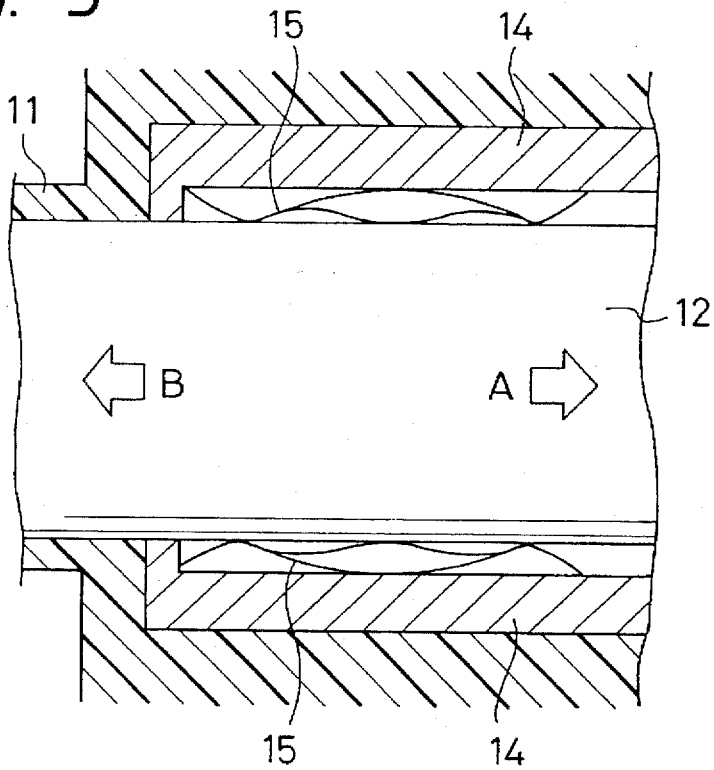
FIG. 3 is an enlarged cross-sectional view of an important portion of the connector of FIG. 1.
Figure 4:
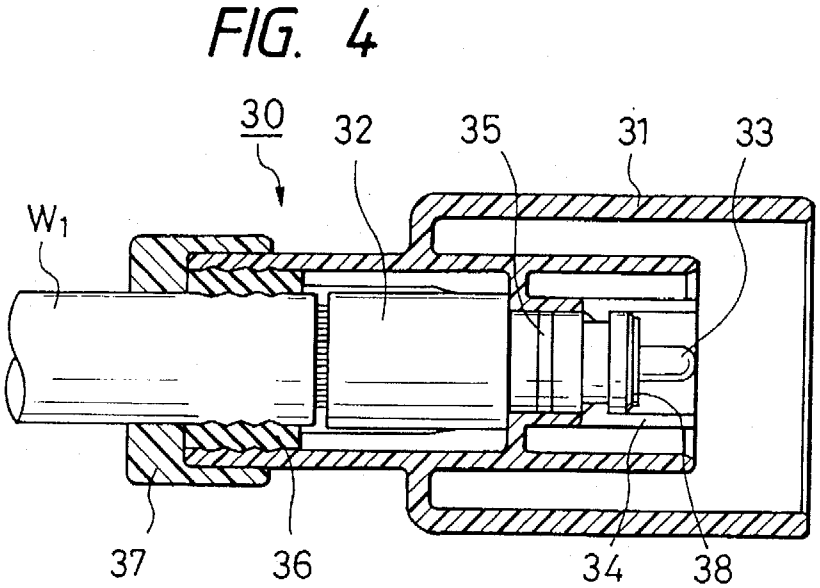
FIG. 4 is a cross-sectional view of a mating connector.
Figure 5:
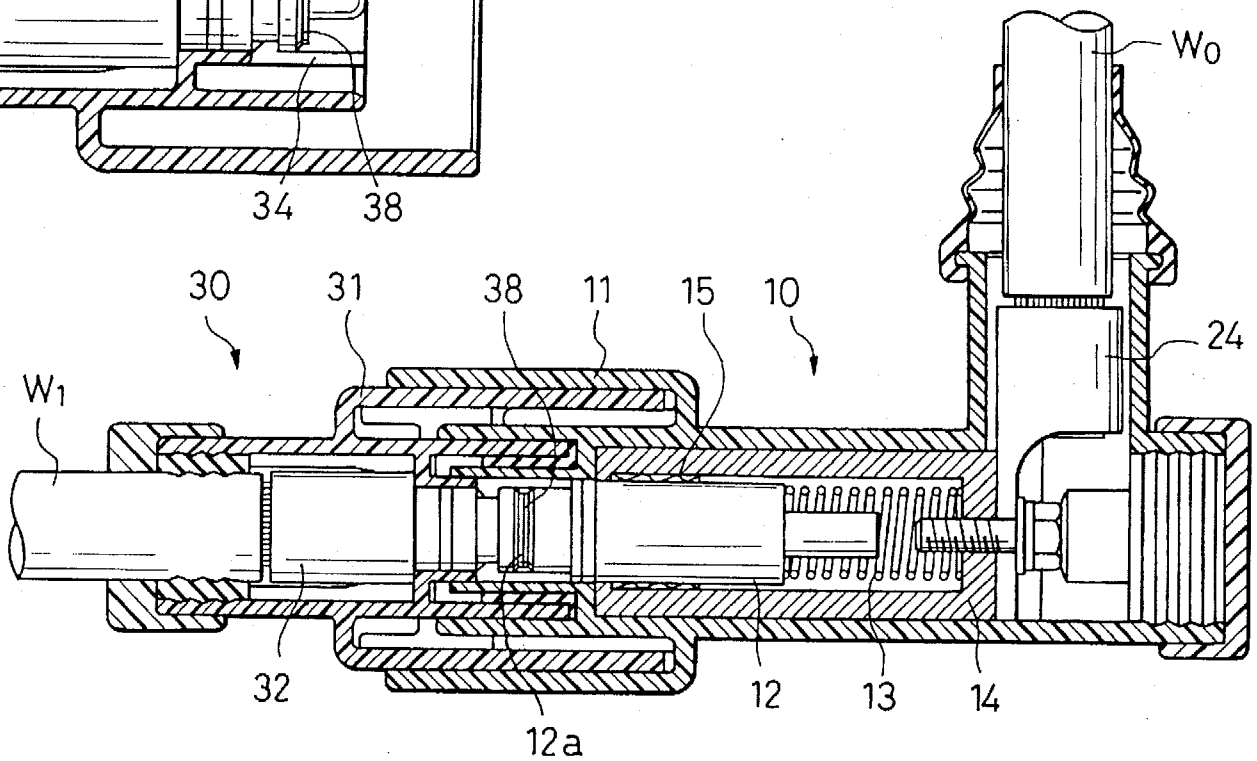
FIG. 5 is a cross-sectional view showing the two connectors in a fitted condition.
Figure 6:
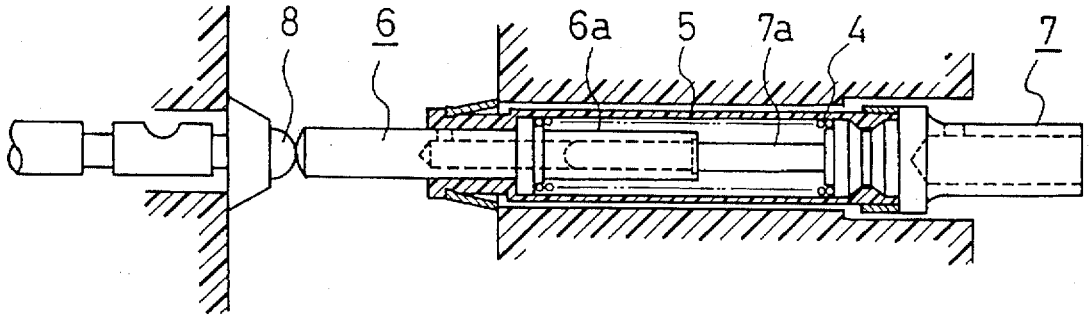
FIG. 6 PRIOR ART
FIG. 6 is a cross-sectional view showing a conventional movable contact member of the butting-type.
Figure 7:
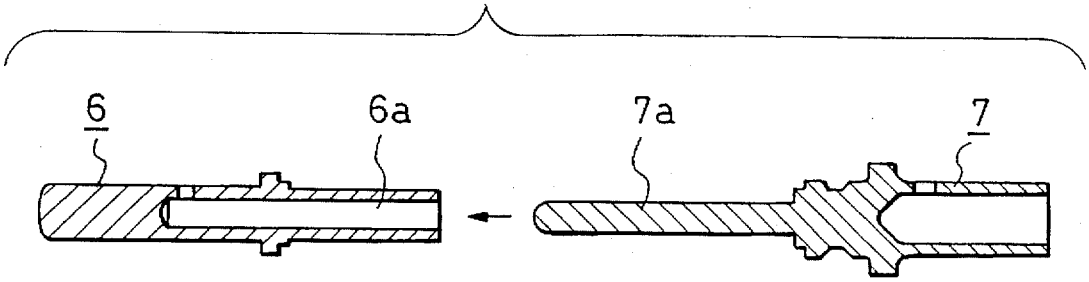
FIG. 7 PRIOR ART
FIG. 7 is an exploded, cross-sectional view showing the movable contact member and a sliding contact member in FIG. 6.

One preferred embodiment of a connector of the present invention will now be described in detail with reference to FIGS. 1 to 5. FIG. 1 is a cross-sectional view showing the construction of the connector of the present invention, FIG. 2 is a perspective view of a contact band in FIG. 1, FIG. 3 is an enlarged cross-sectional view of an important portion of the connector of FIG. 1, FIG. 4 is a cross-sectional view showing the construction of a mating connector, and FIG. 5 is a cross-sectional view showing the two connectors in a fitted condition.

As shown in FIG. 1, the connector 10 of this embodiment includes a connector housing 11 of an integral construction molded of a synthetic resin, and a connection terminal 14 of a hollow construction is fitted in this connector housing 11. A coil spring 13 and a slidable, movable contact member 12 are received in the connection terminal 14. When the two connectors are fitted together, the coil spring 13 urges the movable contact member 12 toward a front end of the connector so as to provide a sufficient contact load. The electrically-conductive, resilient contact band 15 is provided in a gap or space between an outer peripheral surface of the movable contact member 12 and an inner peripheral surface of the connection terminal 14.

Figure 2:
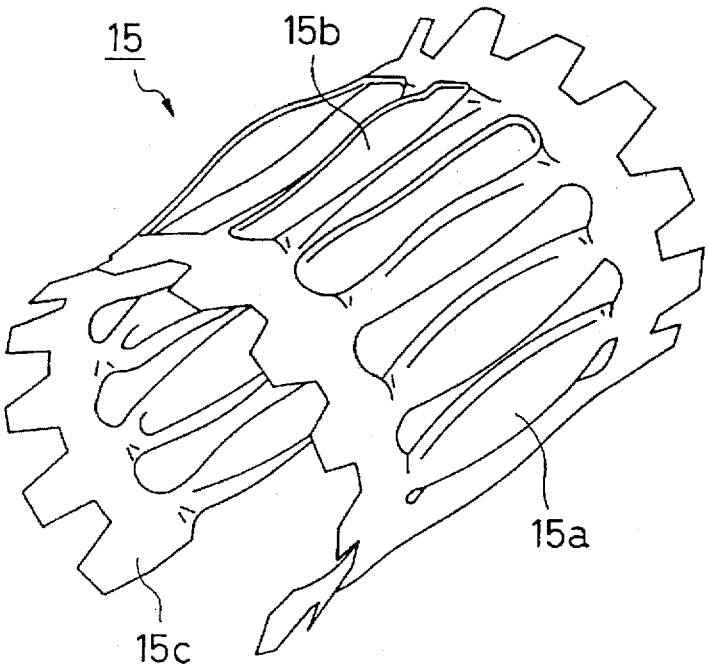
FIG. 2 is a perspective view of a contact band in FIG. 1.

As shown in FIG. 2, the contact band 15 is formed by stamping or blanking a thin metal sheet and then by forming it into a cylindrical shape. More specifically, narrow stamped holes **15*b* are formed through a widthwise-central portion of the thin sheet (in the form of a wide band) in a juxtaposed manner, and the remaining narrow portions of the thin sheet at this central portion are plastically deformed alternately in opposite directions, thereby forming a spring portion 15*a* of a resilient nature. A stopper portion 15*c* of a serrated configuration is formed at each of lateral sides of the contact band 15**.

The connection terminal 14 and the movable contact member 12 are electrically connected together by the contact band 15, and the contact band 15 prevents the movable contact member 12 from being displaced in a direction perpendicular to the axial direction (that is, the direction of fitting of the connector). The contact band 15 also functions as a retaining member for retaining the movable contact member 12 in the connector housing 11 before the connectors are fitted together. Therefore, a more stable sliding movement of the movable contact member 12 is achieved, and a positive electrical connection is achieved.

As shown in FIG. 1, a sub-housing **11*a* extends from that portion of the connector housing 11 adjacent to a rear end thereof and projects in a direction perpendicular to the direction of fitting of the connector housing 11 so that a LA terminal 24, clamped to one end of a connection wire (or cable) W0, can be fixedly connected to the rear end of the connection terminal 14 by a fastening bolt 22. The reason for the provision of this sub-housing is that the connection wire W0 for large current purposes is so thick that it can not be easily bent. Therefore, the overall housing configuration of the connector 10 is of a generally L-shape. A grommet 18 for waterproofing is attached to an outer open end of the sub-housing 11*a***.

The rear end of the connector housing 11 is open so that the fastening bolt 22 can be tightened, and a waterproof rubber plug 17 and a rear holder 23 are mounted on the rear end portion of the connector housing 11. With this construction, the LA terminal 24 is inserted into the connector housing through the open outer end of the sub-housing **11*a*, and then the fastening bolt 22 is introduced and tightened through the open rear end of the housing. By doing so, the LA terminal 24 can be fixedly connected to the connection terminal 14** easily and positively.

For strength waterproofing and so on, the open front end portion of the connector housing 11 is of a double-wall construction having an outer hood portion and an inner tubular portion receiving the movable contact member 12. Dust prevention shutters 19 for preventing dust, which are opened only at the time of fitting the connector, are provided at the hood portion, and a lip packing 25 and a front holder 21 are mounted on the inner tubular portion.

The connection terminal 14 has a tubular shape, and is made of an electrically-conductive material, and has a front open end through which the movable contact member 12 slidably projects. A screw hole is formed in the rear end of the connection terminal 14, and the fastening bolt 22 is threaded into this screw hole. The connection terminal 14 has an inner diameter such that the contact band 15 can be held between the connection terminal 14 and the movable contact member 12 when the movable contact member 12 is inserted into the connection terminal 14.

The movable contact member 12, like the connection terminal 14, has a tubular shape, and is made of an electrically-conductive material. The movable contact member 12 has an abutment portion **12*a* formed at its front end, and has a stopper portion 12*b* formed at its rear end. An O-ring 16 is mounted on the outer peripheral surface of the movable contact member 12. The contact band 15 is provided in the gap between the connection terminal 14 and the slidable, movable contact member 12 as best shown in FIG. 3, so that the movable contact member 12 is held in a predetermined position within the connector housing 11**.

As shown in FIG. 4, the mating connector 30, on which the connector 10 is adapted to be fitted, includes a connector housing 31 of an integral construction molded of a synthetic resin, and a fixed terminal 32, connected to one end of a connection wire W1, is inserted in the connector housing 31. As in the connector 10, a front end portion of this connector housing 31 is of a double-wall construction having a hood portion and an inner tubular portion receiving the fixed terminal 32.

An abutment portion 38 is formed at the front end of the fixed terminal 32, and a resin pin 33 extends from this abutment portion 38, and this resin pin 33 is fitted into the abutment portion **12*a* of the movable contact member 12 when the mating connector is fitted in the connector 10. A front holder 34 and a waterproof O-ring 35 are fittingly mounted on the fixed terminal 32. A rear holder 37 and a waterproof rubber plug 36 are mounted on a rear end portion of the fixed terminal 32**.

The fitting of the connector 10 of the above construction on the mating connector 30 will now be described. As shown in FIGS. 3 and 5, when the connector 10 is fitted on the mating connector 30, the abutment portion **12*a* of the movable contact member 12 is brought into abutment against the abutment portion 38 of the fixed terminal 32, and as the fitting of the two connectors proceeds, the movable contact member 12 is pressed by the fixed terminal 32, and is slidingly moved rearward (in a direction of arrow A) against the resilient force of the coil spring 13**.

Then, when the fitting of the two connectors is completed, the abutment portion **12*a* of the movable contact member 12 is urged forward (in a direction of arrow B) by the resilient force of the coil spring 13, and therefore is held in firm abutting contact with the abutment portion 38 of the fixed terminal 32**, thus providing a sufficient contact load.

At this time, the contact band 15, provided in the gap between the movable contact member 12 and the connection terminal 14 fixedly mounted within the connector housing 11, prevents the movable contact member 12 from being displaced in a direction perpendicular to the sliding direction. Therefore, a more stable sliding movement of the movable contact member 12 is achieved, and the upstream-side connection wire W0 is positively electrically connected to the downstream-side connection wire W1 via the LA terminal 24, the connection terminal 14, the contact band 15, the movable contact member 12 and the fixed terminal 32.

Since the displacement of the movable contact member 12 is prevented as described above, the gap between the connection terminal 14 and the movable contact member 12 will not increase. Therefore, with the aid of the O-ring 16, the rubber plug 17, the grommet 18 and so on mounted in the connector 10, dirt, dust and water are positively prevented from intruding into the sliding surface of the movable contact member 12.

The connector of the present invention is not to be limited to the above embodiment, and any other suitable embodiment may be provided. For example, although this embodiment is directed to the connection connector for large current purposes, the invention can be applied to a charging connector used for charging an electric car.

As described above, in the connector of the present invention, the movable contact member, together with the coil spring, is received in the connection terminal made of an electrically-conductive material, and the contact band, made of a resilient, electrically-conductive material, is slidably provided in the gap between the connection terminal and the movable contact member.

Therefore, the stable sliding movement of the movable contact member is achieved by the contact band, and therefore the movable contact member will not contact the mating terminal in an unstable manner, thereby achieving a positive electrical connection.

And besides, the movable contact member will not be radially displaced during the movement thereof, and therefore dirt and dust are prevented from intruding into the sliding surface of the movable contact member, and a malfunction due to such intrusion is positively prevented. Therefore, a highly-reliable connector is provided.

What is claimed is:

1. A connector for fitting to a mating connector having a fixed terminal, comprising:

a housing including a terminal accommodating chamber;

a connection terminal insertable in said terminal accommodating chamber, said connection terminal having a hollow portion;

a coil spring receivable in said connection terminal;

a contact member slidably fittable in said connection terminal for sliding along an axis of said housing, wherein when said two connectors are fitted together, said contact member is brought into contact with said fixed terminal; and a resilient contact band receivable in a gap between said connection terminal and said contact member.

2. The connector of claim 1, wherein a front end portion of said housing has an outer hood portion and an inner tubular portion for receiving said contact member.

3. The connector of claim 1, wherein said resilient contact band is made of an electrically-conductive material.

4. The connector of claim 1, wherein said connection terminal is made of an electrically-conductive material.

5. The connector of claim 1, wherein said resilient contact band has a plurality of stamped holes, a plurality of recessed strips and stopper portions formed at each sides of said resilient contact band.

6. The connector of claim 1, further comprising an O-ring mountable on an outer peripheral surface of said contact member.

7. The connector of claim 1, further comprising:

a sub-housing extended from an outer surface of said housing; and a terminal connectable to a wire receivable in said sub-housing, said terminal being connectable to said connection terminal.

8. The connector of claim 7, further comprising a fastening bolt fittable through a rear end of said housing to fixedly connect said terminal to said connection terminal.

9. The connector of claim 1, wherein said housing includes:

a sub-housing extended from an outer surface of said housing, said sub-housing projecting in a direction perpendicular to the axis of said housing;

a rear opening portion formed in a rear end of said housing; and a hood portion, for connecting with the mating connector, formed at a front end portion of said housing, said hood portion having an outer hood portion and an inner tubular portion.

10. The connector of claim 9, wherein a terminal connectable to a wire is receivable in said sub-housing, and connectable to said connection terminal.

11. The connector of claim 9, further comprising a grommet attachable to an open end of said sub-housing.

12. The connector of claim 9, further comprising a rubber plug mountable on said rear opening portion.

13. The connector of claim 9, further comprising a shutter mechanism for preventing a dust provided at said hood portion, said shutter mechanism openable when the mating connector is fitted to said hood portion.

14. The connector of claim 9, wherein said inner tubular portion has an inner hood portion and a contact member-receiving portion communicable with said connection terminal for receiving said contact member.

15. The connector of claim 14, further comprising a lip packing mountable between said inner hood portion and said contact member-receiving portion.

* * * * *